US007464509B1

(12) United States Patent
Brown

(10) Patent No.: US 7,464,509 B1
(45) Date of Patent: Dec. 16, 2008

(54) SECURITY WALL

(76) Inventor: James C. Brown, 1735 Trotter Ct., Fort Wayne, IN (US) 46815

( * ) Notice: Subject to any disclaimer, the term of this patent is extended or adjusted under 35 U.S.C. 154(b) by 550 days.

(21) Appl. No.: 11/182,466

(22) Filed: Jul. 15, 2005

(51) Int. Cl.
*E04B 2/00* (2006.01)
*E04B 9/00* (2006.01)
*E04H 12/00* (2006.01)

(52) U.S. Cl. ..... 52/426; 52/653.1; 52/479

(58) Field of Classification Search ..... 52/656.1, 52/581, 580, 265, 267, 269, 649.1, 649.3, 52/653.1, 285.3, 285.4, 309.7, 309.11, 479, 52/649.2, 649.7, 649.8, 425, 426, 655.1; 256/19, 65.01, 65.02, 13.1, 25; 403/353; 211/187, 190, 207, 103, 205, 191, 192, 206
See application file for complete search history.

(56) References Cited

U.S. PATENT DOCUMENTS 1,178,338 A * 4/1916 Niernsee ..... 135/160
1,234,903 A * 7/1917 Jester ..... 52/355
1,641,903 A * 9/1927 Raynor ..... 52/358
1,729,743 A * 10/1929 Jorgensen et al. ..... 52/648.1
1,923,906 A * 8/1933 Berger ..... 52/356
3,303,937 A * 2/1967 McConnell ..... 211/192
3,351,212 A * 11/1967 McConnell ..... 211/192
3,465,895 A * 9/1969 Hyman ..... 211/191
3,468,430 A * 9/1969 Lawman ..... 211/182
3,510,010 A * 5/1970 Gasner ..... 211/192
3,605,367 A * 9/1971 Crawley ..... 52/426
3,886,703 A * 6/1975 Rousey ..... 52/473
4,027,453 A * 6/1977 Bridge ..... 403/353
4,035,977 A * 7/1977 Fischer ..... 52/653.1
4,173,934 A * 11/1979 Searby ..... 108/107
4,185,422 A * 1/1980 Radek ..... 52/36.6
4,285,436 A * 8/1981 Konstant et al. ..... 211/192
4,317,523 A * 3/1982 Konstant et al. ..... 211/187
4,346,540 A * 8/1982 Anderson ..... 52/274
4,597,813 A * 7/1986 Hipkins ..... 156/79
4,708,252 A * 11/1987 Azzi ..... 211/192
4,835,928 A * 6/1989 Scott ..... 52/426
5,097,644 A * 3/1992 Hun ..... 52/456
5,279,430 A * 1/1994 Benton ..... 211/151
5,286,137 A * 2/1994 Cicinnati et al. ..... 404/6
5,413,836 A * 5/1995 Hsieh ..... 428/188
5,653,349 A * 8/1997 Dana et al. ..... 211/189

(Continued)

OTHER PUBLICATIONS

Images downloaded from CD-Rom Revetments v. 2.0, Mar. 2002, Qualification Training Package, HQ AFCESA/CEOF, Tyndall AFB, FL.

(Continued)

*Primary Examiner*—Robert J Canfield
*Assistant Examiner*—Brent W Herring
(74) *Attorney, Agent, or Firm*—Susan L. Firestone; Paul W. O'Malley

(57) ABSTRACT

The security wall of the invention is easy to assemble under field conditions to protect buildings and other objects from explosions, vehicle ramming and artillery projectiles. The security wall has a frame made from interlocking parallel horizontal beams and vertical posts. Tie rods or other stabilizing means can be used to stabilize the frame. After assembling the frame, panels are fastened to the frame. The paneled frame is then filled with fill material and an optional roof paneling can be added to the top of the paneled frame.

8 Claims, 11 Drawing Sheets

U.S. PATENT DOCUMENTS

| | | | | |
|---|---|---|---|---|
| 5,899,035 | A * | 5/1999 | Waalkes et al. | 52/239 |
| 5,941,044 | A * | 8/1999 | Sera | 52/655.1 |
| 5,970,672 | A * | 10/1999 | Robinson | 52/270 |
| 6,009,674 | A * | 1/2000 | Root | 52/167.3 |
| 6,076,323 | A * | 6/2000 | Chiu | 52/562 |
| 6,112,493 | A * | 9/2000 | Rickman | 52/640 |
| 6,125,606 | A * | 10/2000 | Larsson | 52/726.2 |
| 6,205,738 | B1 * | 3/2001 | Chen | 52/653.2 |
| 6,223,916 | B1 * | 5/2001 | Enos | 211/187 |
| 6,286,276 | B1 * | 9/2001 | Shipman et al. | 52/239 |
| 6,547,088 | B1 * | 4/2003 | Wang | 211/187 |
| 6,588,733 | B1 * | 7/2003 | Tremeer et al. | 256/19 |
| 6,634,148 | B2 * | 10/2003 | Shidler | 52/270 |
| 6,711,860 | B2 * | 3/2004 | Fleishman | 52/81.3 |
| 6,920,831 | B2 * | 7/2005 | Lin | 108/107 |
| 7,258,241 | B2 * | 8/2007 | Reid | 211/113 |
| 7,264,416 | B2 * | 9/2007 | Kahl | 403/187 |
| 2004/0036064 | A1 * | 2/2004 | Takagi et al. | 256/65.02 |
| 2005/0035340 | A1 * | 2/2005 | Otte et al. | 256/13.1 |
| 2007/0012904 | A1 * | 1/2007 | Zell et al. | 256/65.06 |
| 2007/0039913 | A1 * | 2/2007 | Chen | 211/192 |
| 2007/0062898 | A1 * | 3/2007 | Choi | 211/192 |

OTHER PUBLICATIONS

Revetment II kit engineering drawings, prefabricated type B-1, Nov. 1, 1995, publically released by U.S.A.F. 1999.

* cited by examiner

SECURITY WALL

BACKGROUND OF THE INVENTION

1. Field of the Invention

The present invention relates to an easy-to-assemble, framed security wall that can be built under field conditions and is used for protecting buildings and other objects from explosives, ramming vehicles and artillery, and a security wall kit for building the security wall.

2. Description of the Prior Art

Security walls protect buildings, equipment, jets, and the like, especially from explosives, ramming vehicles and artillery projectiles. In the case of explosions, such as car bombings or a jet, a well built security wall absorbs the brunt of the explosive force. Thus, a jet isolated within a security wall can explode without igniting nearby parked jets. Security walls should also be difficult to climb over, which would require a tall wall and one without hand and foot holds.

Current security walls have a number of problems. Current walls are cumbersome to build and require a building crew of at least four to six people to assemble. The current walls assemble from a number of shorter panels. Each panel is heavy and awkward, requiring two people to lift. The panels secure to each other using connecting rods that thread through holes in the panels to form a partial wall of about eight feet long. The partial walls then stack on top of each other to form taller walls.

Because the partial walls are even heavier than the panels, for safety purposes a crew of at least four people is used to lift the partial wall to place it on a base partial wall. Building higher walls requires equipment to lift the partial wall high enough to finish the tall security wall.

Currently used security walls also use a number of noninterchangeable parts, such as different sized end panels, side panels, brace panels and cross panels. Because of their different lengths, heights and functions, panels are not interchangeable with each other. The panels can also only be used in one particular orientation to assemble a wall in order for the connecting rods to fasten the panels together. Therefore, to build a wall, the assembly kits require a large number of different parts. Because the panels are limited by size and orientation, the panels are not easily assembled into a large number of different configurations-especially under field conditions.

The security walls are not quickly assembled because the holes in the segments often align poorly. This requires the use of a mallet or sledge hammer to ram the connecting rods down through the holes in the segments.

Therefore, there is a need for a security wall that one or two people can easily assemble. There is also a need for a security wall that can be assembled into a large number of different configurations under field condition. There is also a need for a security wall and its kit that uses a small number of interchangeable parts.

SUMMARY OF THE INVENTION

The security wall of the invention and the kit for building the security wall of the invention use interlocking parallel horizontal beams and vertical posts to build a frame. Tie rods or other stabilizers can be used to stabilize the frame. Each beam has a slat, a transverse ledge along the length of the slat, and opposite first and second beam ends.

Each post has a front, a back opposite the front, and opposite sides therebetween. The sides and the front define side corners, which are adapted to matingly engaging one of the beam ends. The sides and the back define back corners which are adapted to matingly engaging one of the beam ends.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
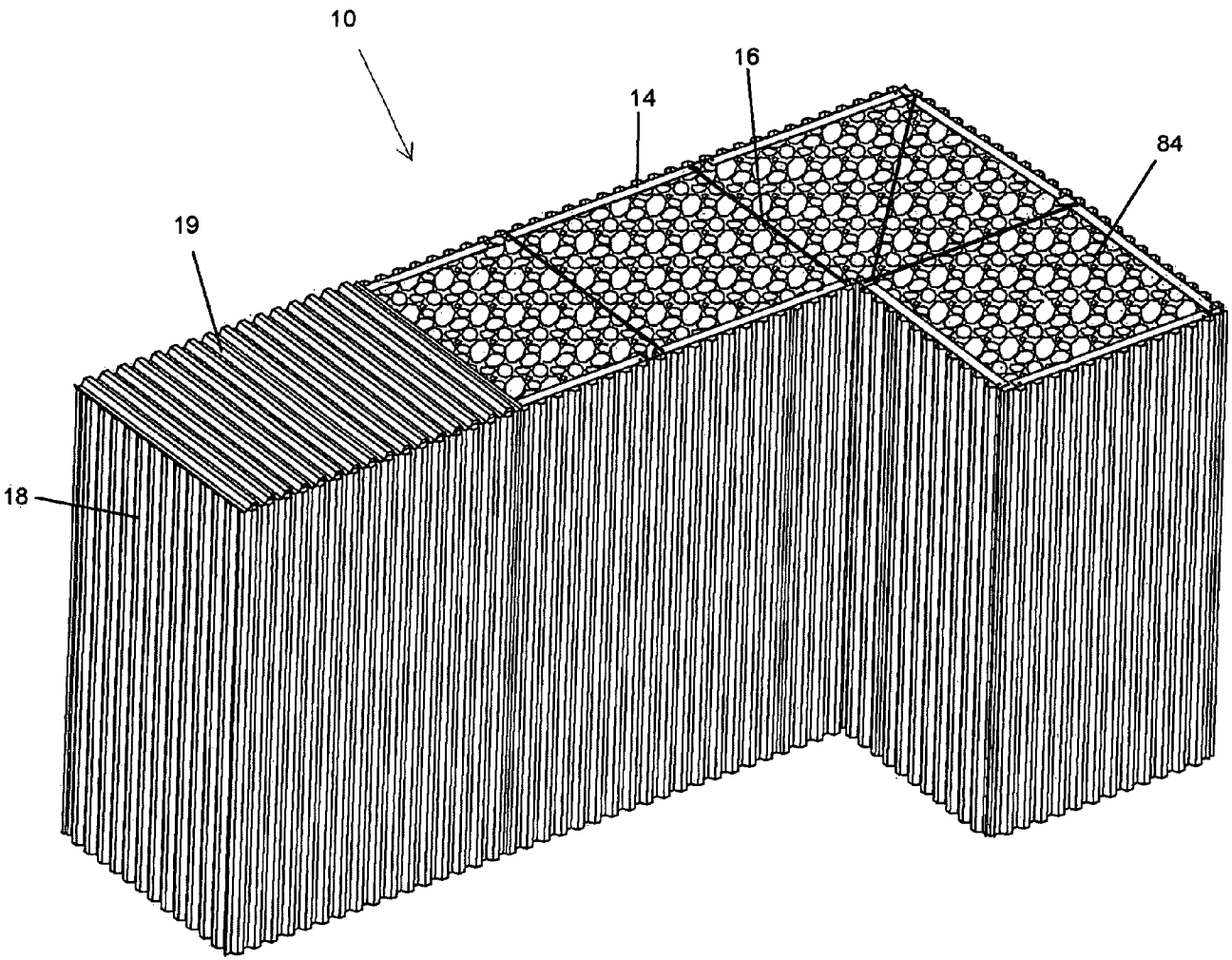
FIG. 1 is a perspective view of a security wall of the invention.
Figure 2:
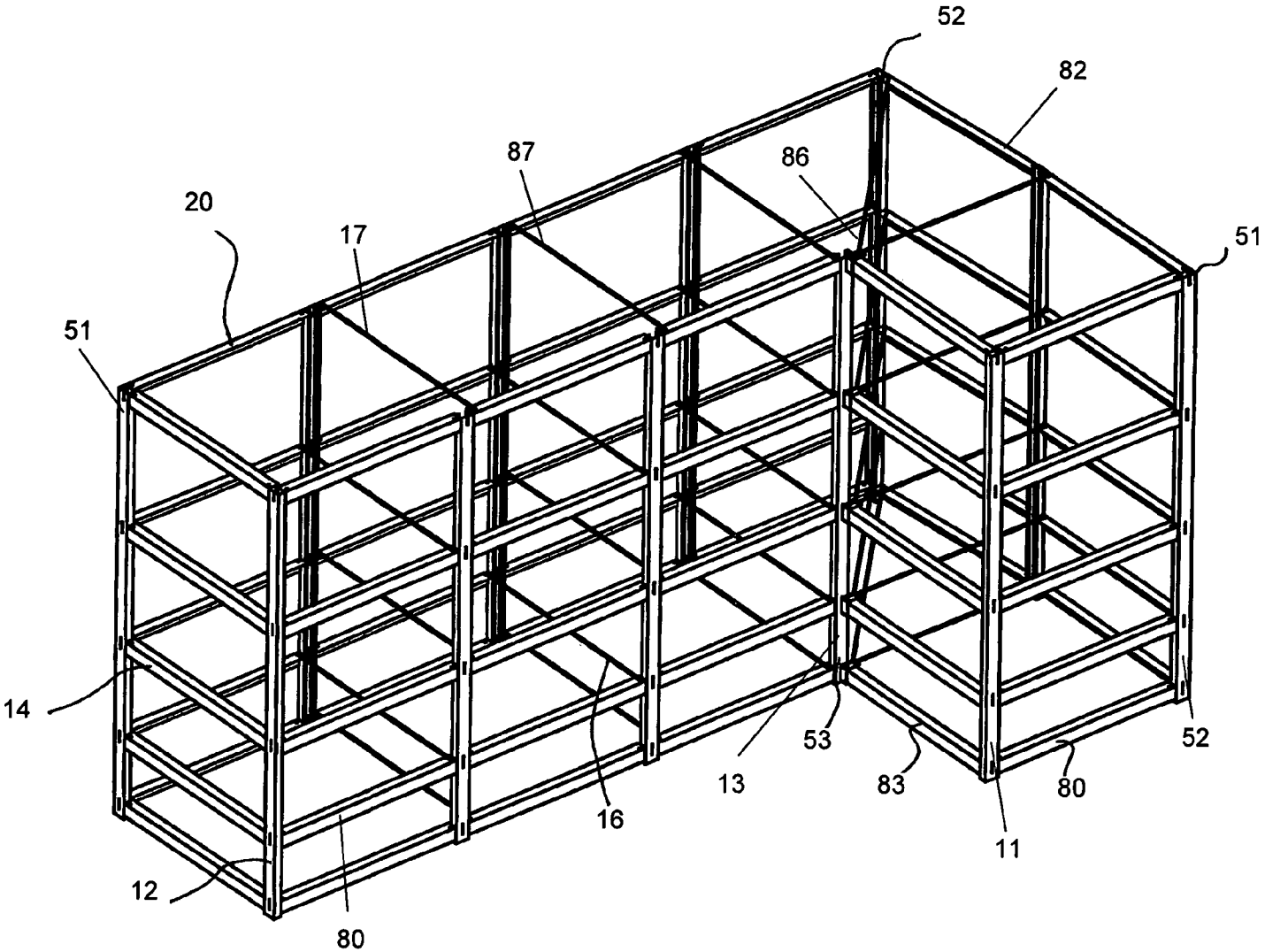
FIG. 2 is a perspective view of a frame for a security wall of the invention.
Figure 3:
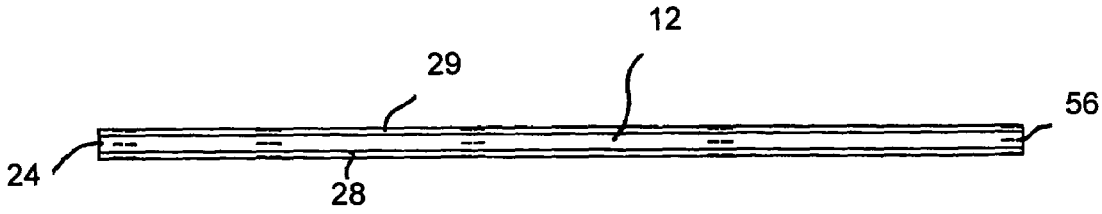
FIG. 3 is rear view a post of the invention.
Figure 4:
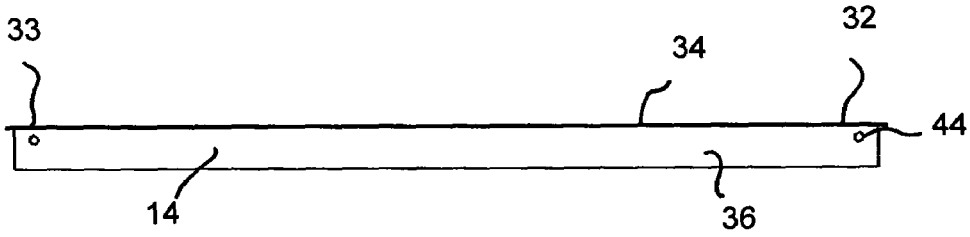
FIG. 4 is a bottom plan view of a beam of the invention.
Figure 5:
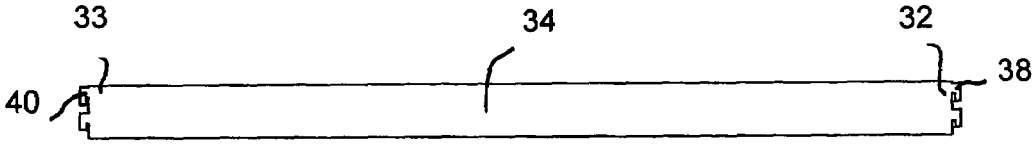
FIG. 5 is a side view of a beam of the invention.
Figure 6:
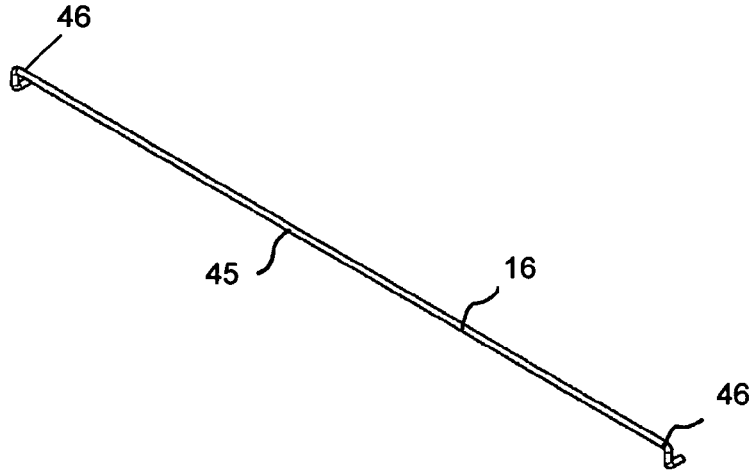
FIG. 6 is a perspective view of a tie rod of the invention.
Figure 7:
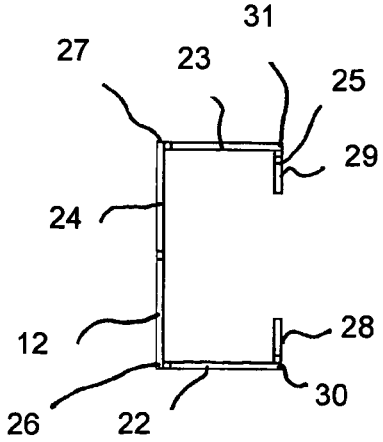
FIG. 7 is a top plan view of a post of the invention.
Figure 8:
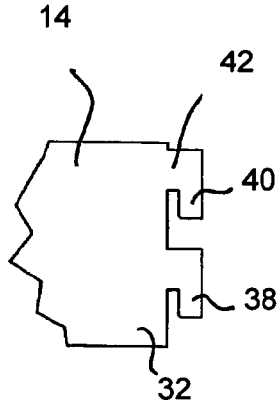
FIG. 8 is a partial side view of a beam of the invention showing the tabs.
Figure 10:
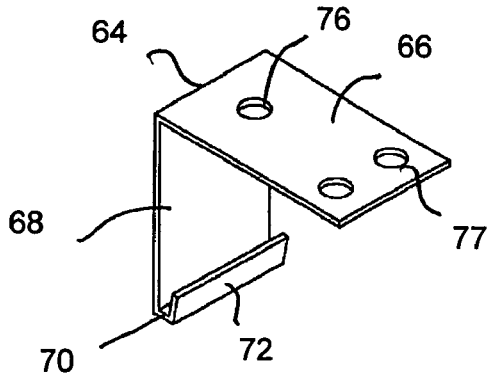
FIG. 10 is a perspective view of a clip of the invention.
Figure 11:
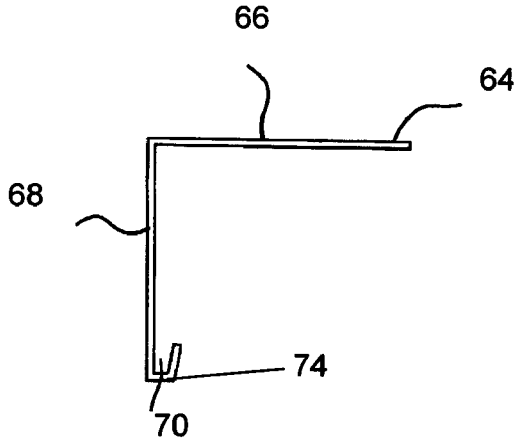
FIG. 11 is a side view of a clip of the invention.
Figure 9:
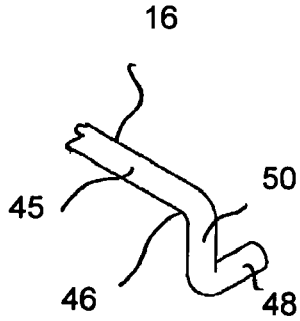
FIG. 9 is a partial perspective view of the tie rod of the invention.
Figure 12:
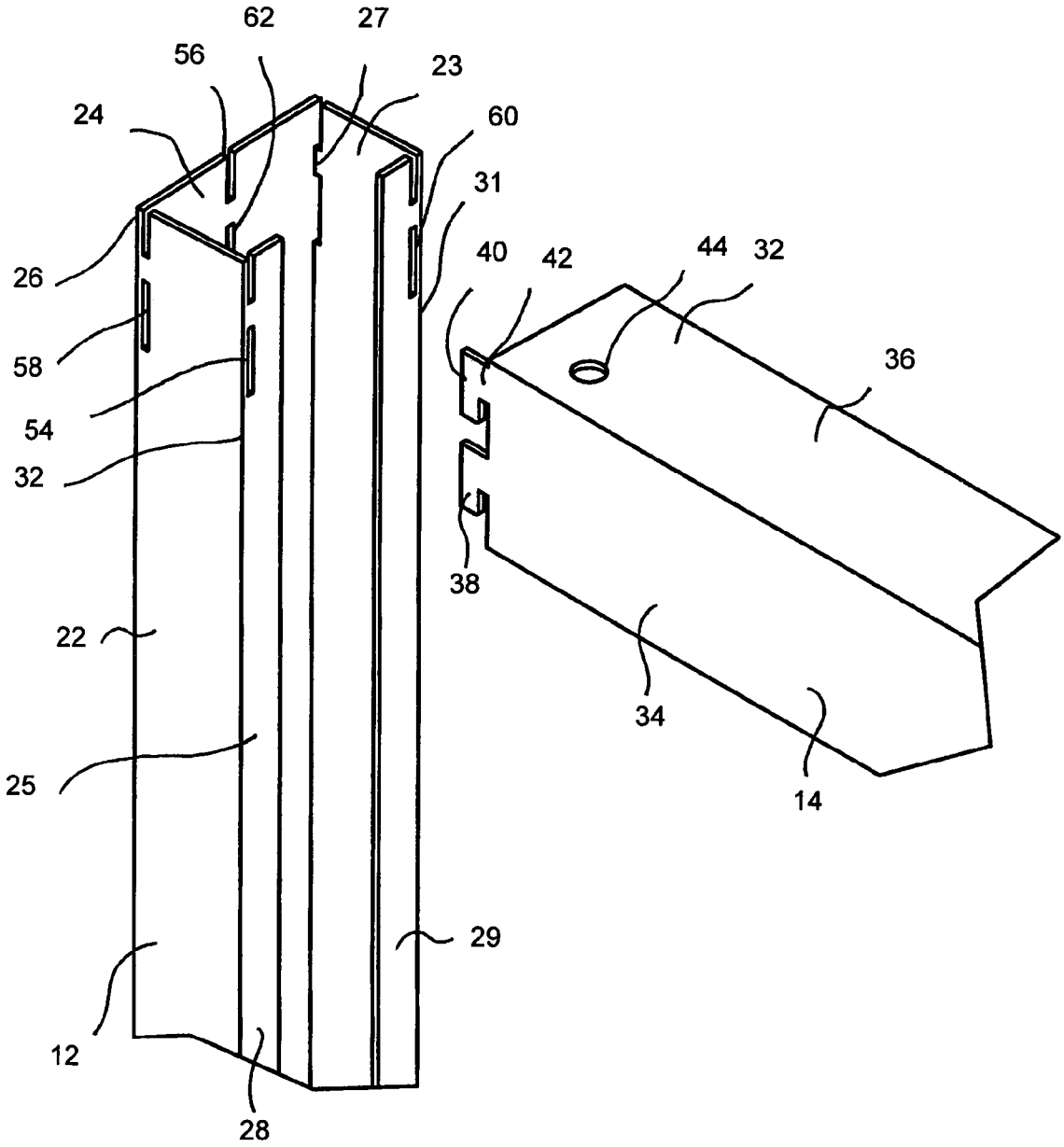
FIG. 12 is a partial perspective view of a beam and post of the invention before engagement.
Figure 13:
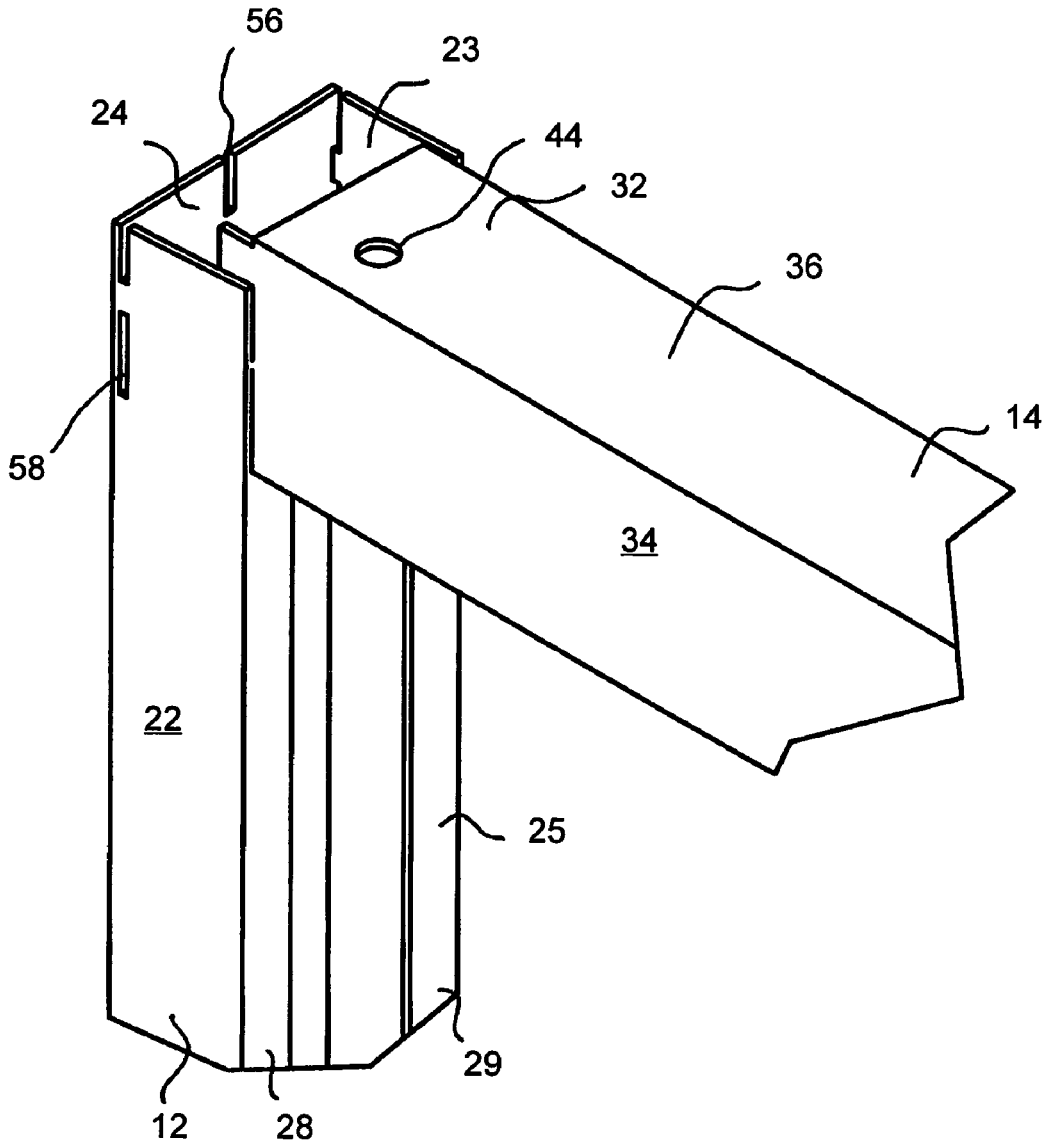
FIG. 13 is a partial perspective view of a beam matingly engaging the post of the invention.
Figure 14:
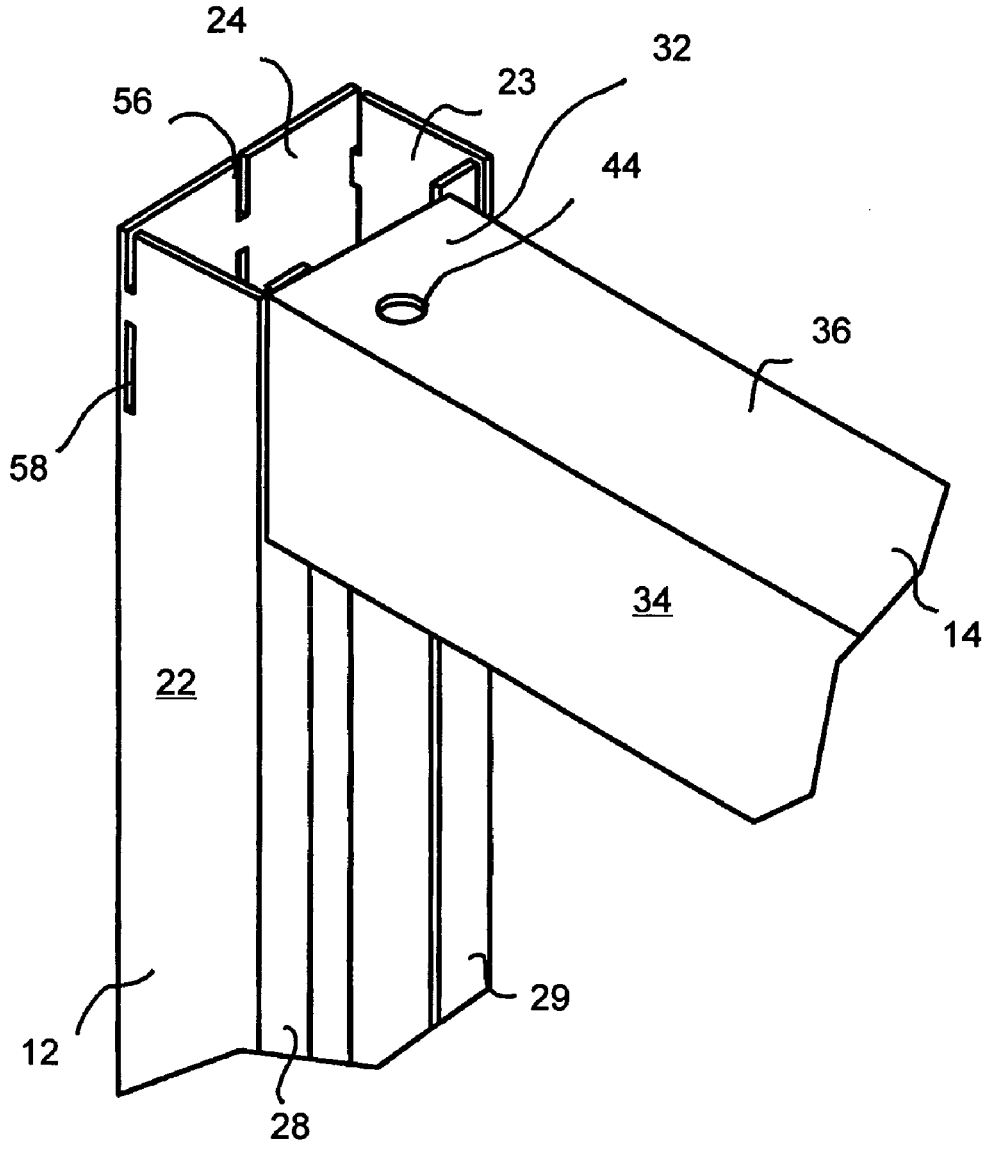
FIG. 14 is a partial perspective view of a beam fully interlocking with the post of the invention.

Turning to the Figures, where like reference numerals refer to like objects, the security wall 10 of the invention and the kit for building the security wall use panels 18 of corrugated metal fastened to a modular frame 20. The frame 20 has vertical posts 12 which matingly engage horizontal beams 14 using interlocking tabs 38 and slots 54. Tie rods 16 matingly engage the horizontal beams 14 for additional structural support.

Each post 12 has an opposite front 24 and back 25 and is preferably rectangular in cross-section. Opposite sides 22, 23 extend outwardly along the length of the front 24 and the back 25, preferably approximately perpendicular to the front 24 and back 25. The sides 22, 23 and the front 24 define side corners 26, 27.

The back 25 is preferably split along the length of the post to define flanges 28, 29 and giving the post 12 a C-shape in cross-section. The flanges 28, 29 extend from each side 22, 23 toward each other opposite the front 24 and are preferably approximately perpendicular to the sides 22, 23. The back 25 and sides 22, 23 define back corners 30, 31.

Slots 54 are regularly arranged along each post 12 and are preferably arranged as pairs, with one slot located above the other. Slots 54 are in the front 24, sides 22, 23 and back 25. Slots 54 are located at the side corners 26, 27, the back corners 30, 31, and preferably the middle of the front 24. Side slots 58 are located in the sides 22, 23 of the side corners 26, 25, although side slots 58 can be located in the intersection of the sides 22, 23 with the front 24 or in the front 24. Back slots 60 are located in the back 25 of the back corners 30, 31, although back slots 60 can be located in the intersection of the back 25 with the sides 22, 23 or in the sides 22, 23. Front slots 62 are located in the front 24 between the side corners 26, 27, preferably in the middle of the front 24. Upper slots 56 at the top of the post 12 are preferably open on top.

Beams 14 have opposite beam ends 32, 33, a slat 34 and a transverse ledge 36 extending along the length of the slat 34. The slat 34 has tabs 38 extending outwardly at each beam end 32, 33 to matingly engage the slots 54 of one of the posts 12. Each tab 38 has a head 40 and a stem 42. The head 40 is preferably rectangular and oriented downwardly when engaging the slot 54. The stem 42 rests on the bottom of the slot 54.

Tie rods 16 matingly engage holes 44 in the ledges 36 at each beam end 32, 33. Both diagonal and transverse tie rods 86, 87 are preferably curved or L-shaped at each of their rod ends 46. A first portion 48 of the rod end 46 curves approximately 90° in a first direction from the rod 45. A second portion 50 curves approximately 90° in a second direction from the first portion 48.

Clips 64 allow more than one tie rod 86, 87 to attach at the corner, especially at the inner corner 53. Clip 64 has a top plate 66 connecting to a transverse plate 68. A lip 72 and a bottom projection 74 from the transverse plate 68 form a channel 70 for receiving the bottom part of the slat 34. The top plate 66 has bores 76, 77 for receiving tie rods 86, 87.

Panels 18 fasten to the frame 20 and are preferably vertically corrugated. Before installing, panel ends 78 are bent using a panel bending tool 88, such as a vice grip, to fit flush against a post 12, which is usually about a 90° angle. Panels 18 fasten to the frame 20 using any fastening method, such as screwing or riveting.

After the panels 18 are fastened to the frame 20, fill material 84, such as sand, dirt, rocks, bricks, debris, and the like, is added between the walls. Fastened or unfastened roof paneling 19 can be added to protect the top of the security wall 10 from the elements.

The security wall 10 of the invention is easy for one or two people to assemble. The first two posts 12 connect with a beam 14 at the bottom to start a corner 51. The user slides the heads 40 of the tabs 38 through the lower slots 54 of each post 12. Additional beams 14 similarly interlock with the first two posts 12 until the first section 80 is complete. Alternatively, the user can start by sliding the tabs 38 of two beams 14 into the slots 54, such as the back slots 60 and the side slots 58.

More beams 14 interlock with the first two posts 12 to continue to form a first wall 82. Additional beams 14 and posts 12 interlock with each other to continue the first wall 82. When building a corner, beams 14 can interlock with the back slots 60 and/or front slots 62 of the inner post 13.

Figure 17:
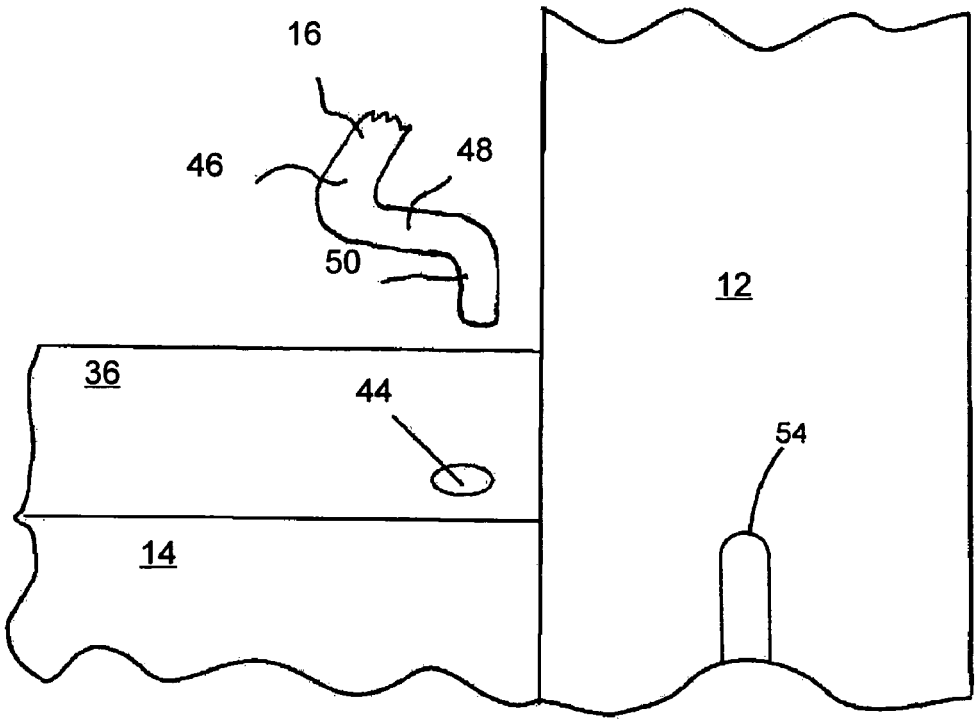
FIG. 17 is a partial plan view of a beam and post of the invention with a tie rod approaching the hole in the ledge.
Figure 18:
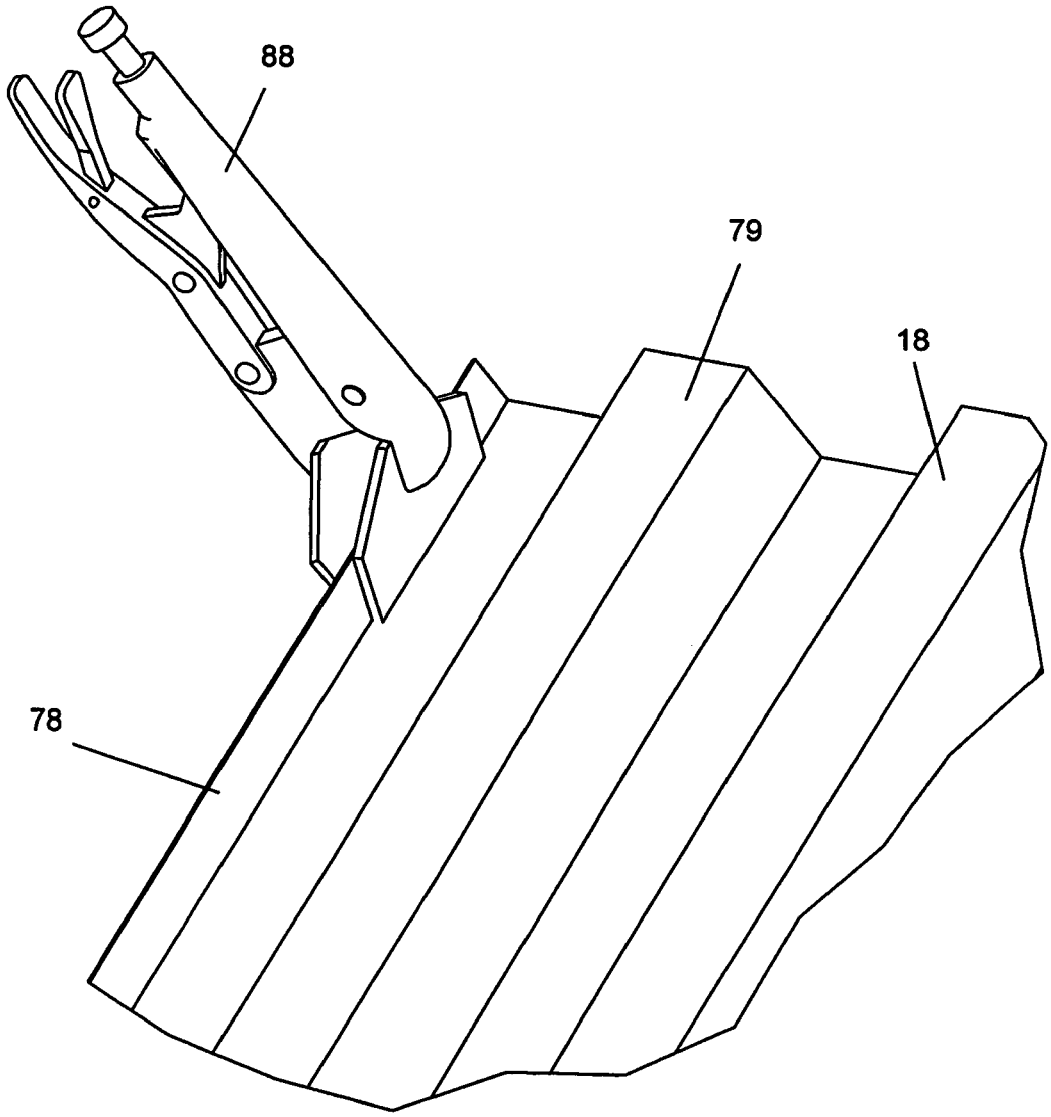
FIG. 18 is a partial perspective view of a panel with a panel bending tool bending a panel end.

The tie rods 16 stabilize the frame 20 by extending from the beams 14 of one wall section to the beams 14 of another wall section, such as the first wall section 82 to the second wall section 83. Each rod end 46, 47 inserts into a hole 44 in the ledge 36, preferably at each beam end 32, 33. During insertion, the second portion 50 is parallel to the post 12 (FIG. 17). Then the second portion 50 of the tie rod 16 slides into the hole 44. The tie rod 16 is rotated until the first portion 48 is parallel to the post 12. This rotation allows the first portion 48 to slide into the hole 44. The second portion 50 is parallel to the plane of the ledge 38. The curved tie rod ends 46, 47 releasably lock the tie rod 16 in place by preventing the removal of the tie rod 16 without being first rotated to allow the second portion 50 to align with and slide out of the hole 44.

Figure 15:
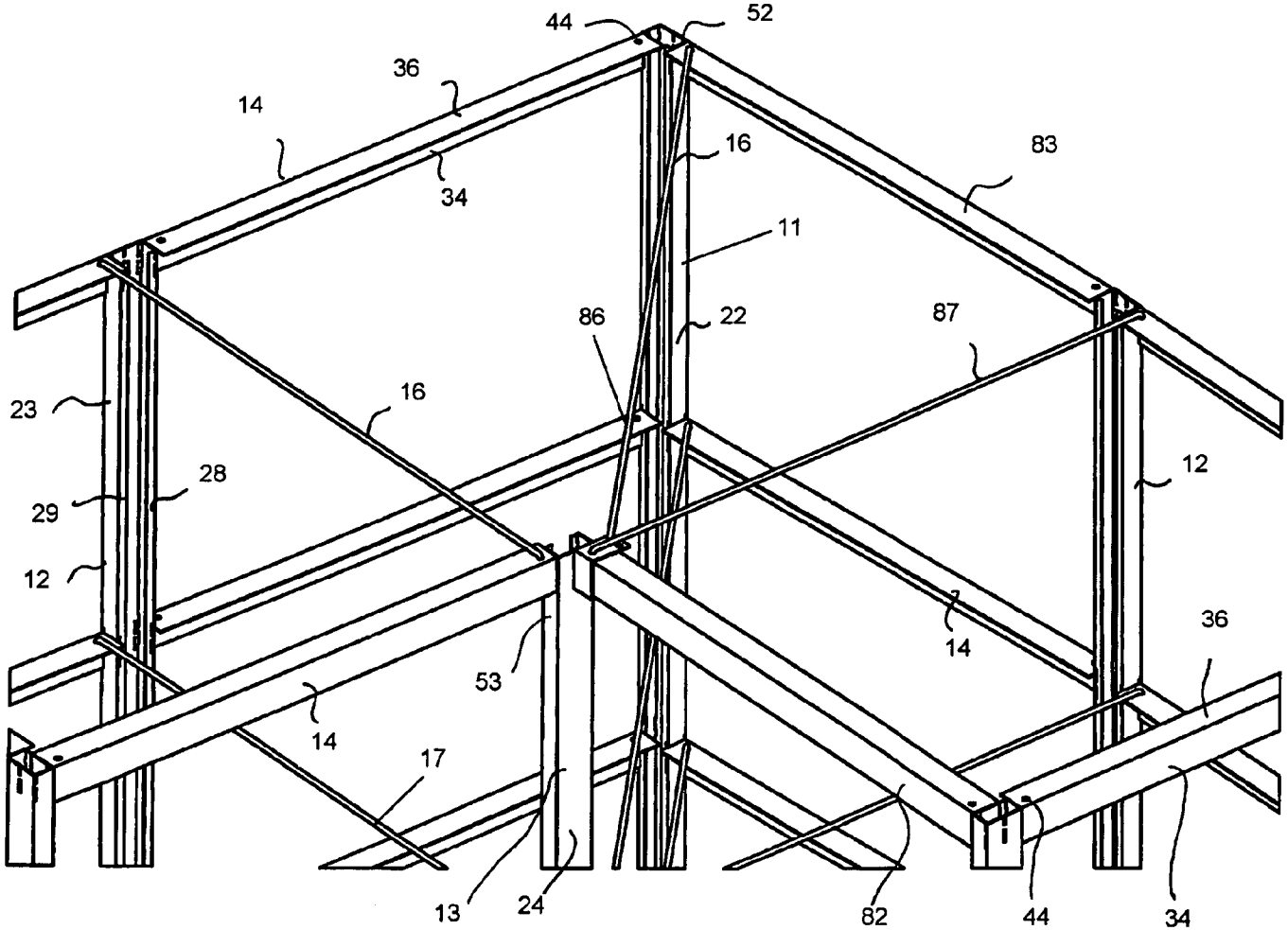
FIG. 15 is a partial perspective view of a frame corner with intersecting wall sections of the frame of the invention.
Figure 16:
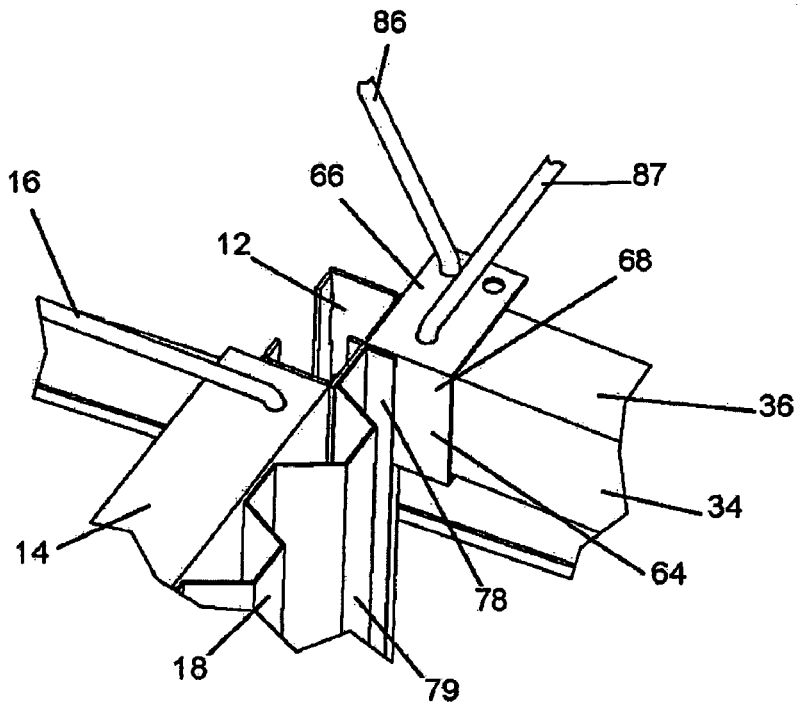
FIG. 16 is a partial perspective view of an inside corner of the security wall of the invention.

The frame corner 51 of the frame 20 as shown in FIGS. 15 and 16, is reinforced using diagonal tie rods 86. Frame corners 51 form from the intersection of two wall sections. Part of the inner frame corner 53, for example, can form from beams 14 inserted into the front slots 62 of the inner post 13. The other part of the inner frame corner 53 forms from other beams 14 inserting within the side slots 58 of the inner post 13. Likewise, the outer frame corner 52 forms from beams 14 inserted into the side slots 58 and back slots 60 of the outer post 11.

Tie rods 16, such as a diagonal tie rod 86, connect the inner frame corner 53 with the outer frame corner 52 of the frame 20. The outer bore 76 of a clip 64 aligns with one of the holes 44 of the beam 14 located in the inner frame corner 53, such as in the first wall section 82. A transverse tie rod 87 inserts into the outer bore 76 and the hole 44 of the opposite beam 14 in the opposite wall section 83. A diagonal tie rod 86 inserts into one of the inner bores 77 of the clip 64 and one of the holes 44 in the beam 14 in the outer frame corner 52 or another clip 64, preferably diagonally from the beam 14 in the inner frame corner 53. Clips 64 can also be used to thread an additional support stabilizer, such as a support rod or wire through one of the inner bores 77 not used for the diagonal tie rod 86 to the clip on another beam 14 in the same wall, such as the first wall section 82 (not shown).

Wall stabilizers 17 include the tie rods 16. Other wall stabilizers 17 can include wire strung across the top and bottom corners of the posts before attaching the panels (not shown). Any wire should be tightened to further stabilize and hold the frame 20 square.

To attach the panels 18, one panel is aligned flush to one end of the frame 20. Once the panel 18 is square to the frame 20, the panel 18 fastens to the beams 14 with fasteners in every other inside rib 79 of a corrugated panel. The panel 18 at the end of the frame 20 may need to overlap the next panel 18 in order to fit. Overlapped panels 18 can fasten to the frame 20 with an additional fastener between each beam 14, such as with stitcher screws. The process is repeated until the frame 20 is completely paneled. The assembled security wall 10 is now ready for fill material 84 to be poured into the frame 20. Optional roof paneling 19 can be added to the top of the security wall 10.

Because the beams, posts and tie rods are adapted to fit each other, a security wall kit with the components of the security wall can be assembled in a variety of configurations. This allows the security wall's configuration to match field conditions. The security wall kit may also include assembly instructions.

The security wall of the invention has a number of advantage. One or two people can easily assemble the security wall. The security wall can be assembled from a kit into a number of different configurations to match the location and needs in the field. The security wall and its kit uses interchangeable parts which is economical and allows the user to build the wall to fit the terrain.

The security wall components can be economically made. Slots can be stamped out of a blank. The blank can then be folded to form posts.

While the invention is shown in only one of its forms, it is not thus limited but is susceptible to various changes and modifications without departing from the spirit and scope of the invention.

What is claimed is:

1. A security wall comprising:

a frame having parallel horizontal beams, and vertical posts matingly engaging the beams with interlocking tabs and slots;

each beam having a slat, opposite first and second beam ends, a transverse ledge along the length of the slat and having holes at the beam ends;

each post having a front, a back opposite the front and opposite sides therebetween;

a side corner being defined by the sides and the front of the vertical posts;

a back corner being defined by the sides and the back of the vertical posts;

tie rods matingly engaging two of the beams;

each tie rod engaging beams located in opposite wall sections and having a rod, and opposite curved rod ends comprising a first portion curving away from the rod and engaging the hole of the ledge, and a second portion curving away from the first section and being parallel to the plane of the ledge;

a wall section being formed by two of the posts and at least two beams interlocking to the two posts;

inner and outer frame corners forming from the intersection of two wall sections;

a clip having a transverse plate, a top plate connecting to the transverse plate, an inner bore in the top plate, and an outer bore in the top plate being aligned with one of the holes in the ledge and matingly engaging a first tie rod;

wherein the slots further comprise at least one side slot being located at each side corner, at least one back slot being located at each back corner, and at least one front slot being located in the front between the opposite side corners; and wherein one of the tie rods connects the inner frame corner with the outer frame corner.

2. A security wall of claim 1, wherein one of the tie rod ends matingly engages the inner bore in the clip located on one wall section, and the opposite tie rod end matingly engages the hole in the beam located in the opposite wall section.

3. A security wall of claim 2, wherein one of the tie rod ends matingly engages the inner bore in the clip located on one wall section of the inner frame corner, and the opposite tie rod end matingly engages the hole in the beam located on one wall section of the outer frame corner.

4. A security wall of claim 3, further comprising:

panels fastened to the frame.

5. A security wall of claim 4, further comprising:

fill material located within the frame.

6. A security wall of claim 5, further comprising:

roof paneling on top of the wall sections.

7. A security wall kit comprising:

a plurality of horizontal beams, each beam having a slat, opposite first and second beam ends, a transverse ledge along the length of the slat and having holes at the beam ends, and tabs extending outwardly from the beam ends;

a plurality of posts, each post having a front, a back opposite the front, opposite sides therebetween, and slots in the front, back and sides being adapted to matingly engage the tabs a plurality of tie rods, each tie rod having a rod, and opposite curved rod ends comprising a first portion curving away from the rod and being adapted to engage the hole of the ledge, and a second portion curving away from the first section;

a side corner being defined by the sides and the front of the vertical posts;

a back corner being defined by the sides and the back of the vertical posts;

a clip having a transverse plate, a top plate connecting to the transverse plate, an inner bore in the top plate, and an outer bore in the top plate adapted to being aligned with one of the holes in the ledge and matingly engaging one of the tie rods;

panels adapted to fit against assembled posts and beams;

wherein the slots comprise at least one side slot being located at each side corner, at least one back slot being located at each back corner, at least one front slot being located in the front between the opposite side corners; and wherein the tie rods include diagonal tie rods which are adapted to engage the inner bore of the clip on a first beam and the hole in a second beam.

8. A security wall kit of claim 7, further comprising:

roof paneling adapted to fit on top of assembled posts and beams.

* * * * *